United States Patent [19]

Mehlau et al.

[11] Patent Number: 4,909,104

[45] Date of Patent: Mar. 20, 1990

[54] CRANK-OPERATED TORQUE TOOL

[75] Inventors: Hans-Joachim Mehlau, Solingen; Horst Butanowitz, Heiligenhaus, both of Fed. Rep. of Germany

[73] Assignee: Eduard Wille GmbH & Co., Fed. Rep. of Germany

[21] Appl. No.: 172,559

[22] Filed: Mar. 24, 1988

[30] Foreign Application Priority Data

Mar. 27, 1987 [DE] Fed. Rep. of Germany ... 8704541[U]

[51] Int. Cl.[4] ..... B25B 9/02

[52] U.S. Cl. ..... 81/35

[58] Field of Search ..... 81/35

[56] References Cited

U.S. PATENT DOCUMENTS 796,201 8/1905 Frampton ..... 81/35

1,537,657 5/1925 Burch ..... 81/35

1,748,246 2/1930 Russell .

FOREIGN PATENT DOCUMENTS 1153020 5/1969 United Kingdom .

*Primary Examiner*—Frederick R. Schmidt

*Assistant Examiner*—Lawrence Cruz

*Attorney, Agent, or Firm*—Philip A. Mallinckrodt; Robert R. Mallinckrodt

[57] ABSTRACT

A crank operated torque tool has a tool holder shaft with an offset central portion and two straight, aligned, end members forming a crank. One end of the tool is preferably formed to receive and temporarily secure a torque tool. The other end has one end of an elongate, cylindrical, handle piece rotatably attached thereto, the other end of the handle piece being adapted to removably and rotatably receive a disc-shaped, thrust piece.

3 Claims, 1 Drawing Sheet

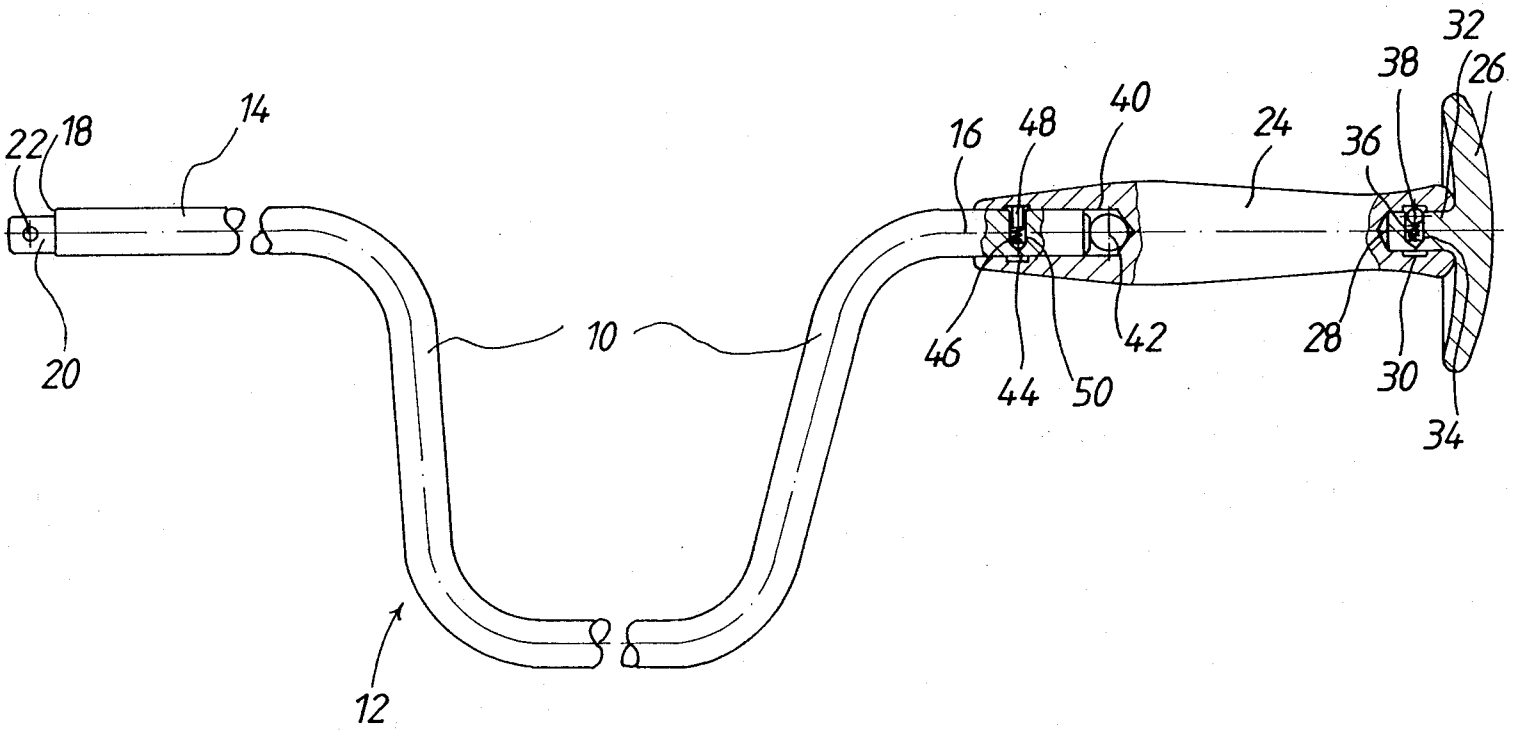
32
26
34
38
30
36
28
24
40
42
50
48
44
16
46
10
12
14
18
20
22

CRANK-OPERATED TORQUE TOOL

BACKGROUND OF THE INVENTION

1. Field

The invention relates to crank operated torque tools.

2. State of the Art

Crank-operated torque tools that have a tool-holding shaft with an offset portion and two straight end members forming a crank are known, as in German Pat. No. 429,058 of May 17, 1926. In that patent, a disc-shaped thrust piece is rotatably mounted on one end of the shaft, whereby an axial thrust can be exerted on the tool by pressing on the thrust piece and torque can be exerted on a tool held on the shaft by rotating the crank formed by the offset portion of the shaft. The thrust piece is permanently mounted on the shaft.

A known screw driver tool, see British Pat. No. 1,153,020 of Nov. 14, 1967, having a straight shaft with a screw driver formed at one end and a cylindrical handle at the other end is provided with a disc-shaped thrust piece that is adapted to be removably placed on the cylindrical handle. For this purpose, the thrust piece is provided with a stub shaft for insertion in a socket formed in the end of the handle. The pin is retained by a ball detent.

A screw driver having a shaft formed as an angularly oriented, L-shaped crank at its handle end has an elongate, rotatably mounted, cylindrical handle, see German Patent Application No. 2,149,188 of Oct. 1, 1071.

SUMMARY OF THE INVENTION

The invention provides a crank-operated torque tool that can be used with or without the special exertion of axial thrust.

A removable, disc-shaped, thrust piece is provided at the end of a rotatable handle mounted as a longitudinal extension of the straight end member of a crank shaft opposite the tool holding end of the shaft, such that a torque tool member held by such tool holding end of the shaft can be crank operated with or without the thrust piece.

THE DRAWING

The best mode presently contemplated for carrying out the invention in actual practice is illustrated in the accompanying drawing in which the single figure is a side elevation, partially in vertical section, of a crank-operated torque tool in accordance with the invention, intermediate portions being broken out for convenience of illustration.

DETAILED DESCRIPTION OF THE ILLUSTRATED EMBODIMENT

As illustrated, the crank-operated torque tool comprises a shaft 12 having an intermediate offset portion 10 and a pair of oppositely extending straight end members 14 and 16, respectively. A square connection member 20 is provided at the free end 18 of the straight member 14, with a spring-loaded detent ball 22 located in a lateral face thereof for retaining a received torque tool member, such as a screw driver or a wrench socket.

An elongate handle 24 is rotatably mounted but axially retained on the straight end member 16 as a longitudinal extension thereof. It is preferably cylindrical.

A disc-shaped, thrust piece 26 is provided for installation on the free end of handle 24. Thrust piece 26 is adapted to be rotatably mounted on handle 24. To this end, handle 24 has a blind bore 28 in its end face. An annular groove 30 is formed in the cylindrical wall of blind bore 28. Thrust piece 26 has a central stub shaft 32, which fits into bore 28 and is held in place by a detent arrangement comprising a transverse blind bore 34 in stub shaft 32 in which is a detent spring 36 and a detent ball 38. Detent ball 38 snaps into annular groove 30 under the action of detent spring 36 when stub shaft 32 is inserted into bore 28 of handle 24. Thrust piece 26 is kept axially snapped in place relative to the rotatable handle 24 when axial thrust is exerted on thrust piece 26.

In the end face at the opposite end of handle 24 a blind bore 40 is provided in alignment with blind bore 28, so that free end of shaft straight member 16 can be inserted into such blind bore 40. A thrust-receiving ball 42 is inserted in blind bore 40 for contact with the end face of the received end of shaft straight member 16, which is held in place by a locking arrangement that includes an annular groove 44 formed in the cylindrical wall of blind bore 40, a transverse blind bore 50 formed in the received end of shaft straight member 16, and a cylindrical locking pin 48 pressed into groove 44 under the action of a compression spring 46 positioned in blind bore 50.

When the tool is assembled, shaft straight end member 16 is inserted into blind bore 40 until its end face engages ball 42. Locking pin 48 then snaps into annular groove 44 of blind bore 40. Contrary to the detent engagement by detent ball 38, this locking engagement cannot be released by an axial tractive force but permits rotation of shaft 12 with respect to handle 24.

As can be seen, thrust piece 26 directly engages the contiguous end face of handle 24. A thrust force is thus directly exerted by thrust piece 26 into handle 24 and is transmitted from handle 24 through ball 42 onto shaft 12, without loading detent 38. Thrust piece 26 can be placed on handle 24 in any position because of its rotatability.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A crank-operated torque tool, comprising a crank shaft having an intermediate offset portion forming a crank member between a pair of oppositely extending straight members that are connected at one end to said offset member and have the other end free thereof; means for holding a torque tool member at the free end of one of said straight members; a disc shaped thrust piece; an elongate handle member between said thrust piece and the free end of said other of the straight members, said other of the straight members terminating at said handle member so that said handle member is the sole structure extending between said free end of said other of the straight members and said thrust piece; and means rotatably coupling said handle member to the free end of the other straight member, said means comprising a blind cylindrical bore in the corresponding end of and extending longitudinally of said handle member, an annular groove in the cylindrical surface of said bore, a transverse bore in said free end of said other straight member, a spring-biased locking pin in said transverse bore and projecting into said annular groove, and a thrust ball interposed in said blind bore in contact with the bottom thereof and with said free end of said other straight member, so that thrust exerted on said thrust piece is transmitted to said crank shaft solely through said handle member, said means being constructed and arranged with respect to said thrust piece to provide relative rotatability between said thrust piece and said handle member and quick and easy separability by force exerted axially thereof, and being constructed and arranged with respect to said other of the straight members so as to provide relative rotatability between said handle member and said other of the straight members.

2. A crank-operated torque tool according to claim 1, wherein the thrust piece is rotatably coupled to the opposite end of the handle member by a detent arrangement made up of a blind cylindrical bore ins aid opposite end of the handle member and aligned with the other said blind bore; an annular groove in the cylindrical surface of the blind bore of said detent arrangement; a stub shaft extending fixedly and centrally from the thrust piece for insertion in said blind bore of said detent arrangement; and transverse detent means held in said stub shaft and spring biased for projection into said annular groove of said blind bore of said detent arrangement.

3. A crank-operated torque tool according to claim 2, wherein the underside of the thrust piece is in contact with the end face of the said opposite end of the handle.

* * * * *